US005131566A

United States Patent [19]

Bavegems

[11] Patent Number: 5,131,566

[45] Date of Patent: Jul. 21, 1992

[54] FLOWABLE PRODUCT PACKAGE INCORPORATING A REFILL FACILITATING POURING SPOUT

[75] Inventor: Guy A. L. Bavegems, Boortmeerbeek, Belgium

[73] Assignee: The Procter & Gamble Company, Cincinnati, Ohio

[21] Appl. No.: 592,168

[22] Filed: Oct. 3, 1990

[30] Foreign Application Priority Data

Oct. 5, 1989 [GB] United Kingdom ..... 89-22478.6

[51] Int. Cl.[5] ..... B67D 5/00

[52] U.S. Cl. ..... 222/80; 222/109; 141/330; 141/364

[58] Field of Search ..... 222/80, 109, 81, 83, 222/83.5; 141/329, 330, 363, 364, 365, 366

[56] References Cited

U.S. PATENT DOCUMENTS

| | | | |
|---|---|---|---|
| 167,548 | 9/1875 | Lilley | 141/342 |
| 2,198,564 | 4/1940 | Robison | 222/835 X |
| 2,258,636 | 10/1941 | Young et al. | 222/83.5 X |
| 2,678,829 | 8/1954 | Horrocks | 141/330 |
| 2,703,670 | 3/1955 | Voight | 226/33 |
| 2,767,744 | 10/1956 | Beerman | 141/319 |
| 3,288,178 | 11/1966 | Johnson | 141/330 |
| 4,201,208 | 5/1980 | Cambio, Jr. | 128/214.2 |
| 4,253,459 | 3/1981 | Willis | 128/272.3 |
| 4,289,255 | 9/1981 | Strampe | 222/81 |
| 4,322,019 | 3/1982 | Smith | 141/330 X |
| 4,497,351 | 2/1985 | Garcia | 141/329 |
| 4,550,862 | 11/1985 | Barker et al. | 222/109 |
| 4,557,825 | 12/1985 | Wittes et al. | 209/3 |
| 4,576,313 | 3/1986 | Smith et al. | 222/81 |
| 4,614,437 | 9/1986 | Buehler | 141/329 X |
| 4,671,331 | 6/1987 | Pruden | 141/98 |
| 4,723,688 | 2/1988 | Munoz | 222/88 |
| 4,773,560 | 9/1988 | Kittscher | 222/109 |
| 4,890,768 | 1/1990 | Robinson | 222/109 |
| 5,016,757 | 5/1991 | Chatourel | 222/83.5 X |
| 5,020,690 | 6/1991 | Kishikawa et al. | 222/81 X |

FOREIGN PATENT DOCUMENTS

| | | | |
|---|---|---|---|
| 534496 | 1/1955 | Belgium | 222/81 |
| 0082778 | 6/1983 | European Pat. Off. . | |
| 0131132 | 1/1985 | European Pat. Off. . | |
| 0109704 | 10/1987 | European Pat. Off. . | |
| 0275833 | 7/1988 | European Pat. Off. . | |
| 297967 | 1/1989 | European Pat. Off. | 222/109 |
| 0369722 | 5/1990 | European Pat. Off. . | |
| 2239726 | 2/1974 | Fed. Rep. of Germany | 141/330 |
| 1420585 | 11/1965 | France | 141/329 |
| 530756 | 7/1955 | Italy | 222/81 |
| 9014288 | 11/1990 | World Int. Prop. O. | 222/83 |

*Primary Examiner*—Michael S. Huppert
*Assistant Examiner*—Anthoula Pomrening
*Attorney, Agent, or Firm*—Richard C. Witte; E. Kelly Linman; Michael E. Hilton

[57] ABSTRACT

A package for flowable products incorporating a refill facilitating pouring spout structure. The pouring spout portion of the structure is equipped with a piercing element along its uppermost edge. The refill package of flowable product preferably comprises a flexible pouch which is positioned on top and over the refill facilitating pouring spout structure. The piercing element on the refill pouring spout portion of the structure pierces the bottom of the flexible refill package and the bulk of the flowable product contained therein runs through the pouring spout portion of the structure into the container. Any flowable product running over the outside walls of the pouring spout portion of the structure runs into the container via a drain back feature and vent hole provided at the base of the pouring spout portion of the structure. The refill facilitating pouring spout structure is preferably provided with screw threads for releasably attaching it to the container.

6 Claims, 3 Drawing Sheets

FLOWABLE PRODUCT PACKAGE INCORPORATING A REFILL FACILITATING POURING SPOUT

TECHNICAL FIELD

The present invention relates to a package for flowable products, like liquids, and, more particularly, to a package which includes a feature which will enhance clean refilling with product contained in another, possibly closed package.

BACKGROUND OF THE INVENTION

Many flowable products, and more particularly liquids, are frequently packed in plastic containers. Once the contents have been used, the plastic container is thrown away. These containers have frequently been designed in such a way that they are easy to handle in the context of the purpose the packed product is to serve. As a consequence, it is desirable to find a way to be able to reuse these containers, both from an economical and from an environmental point-of-view, by refilling them with product contained in a simple, cheap and easily disposable package.

Refilling of containers for fabric softening liquids has become current practice. In general, these containers consist of bottles with a neck and an easy pouring, self-draining feature, whereas the refill packages consist of soft, plastic-like pouches. A number of attempts have been made to improve the opening and pouring feature of these pouches, but the resulting operations of opening the pouch and refilling an empty container with the liquid poured from a pouch remains a complex operation.

European patent application 0 082 778 discloses a combination of containers consisting of a canister and a bottle, whereby the neck of the canister is dimensioned so as to receive the neck of the refill bottle in inverted position and does furthermore comprise an insert which is provided to destruct the closure of the inverted refill bottle. Although this combination allows refilling of a container with the contents from another, closed container, without unnecessary spilling, it is important that the necks of canister and refill bottle be compatible, which is detrimental to flexibility in use of refill packages. Furthermore, other, very desirable features in liquid dispensing from a container, will have to be eliminated in order to accomodate the parameters necessary to achieve the combination disclosed in EPO 0 082 778.

European patent application 0 109 704, discloses a liquid dispenser package comprising a self-draining feature, whereby any product which is running down outside the pouring spout through which it has been dispensed, or from the inside of the measuring/closing cap by which it has been dosified, returns to the inside of the package. However, there is no feature which would facilitate pouring of product from another container, into the package.

In light of the above, a principal object of the present invention is to provide a package for flowable products incorporating a refill facilitating pouring spout.

It is another object of the invention to provide this package with a refill facilitating pouring spout while still retaining the benefit of features enhancing clean dispensing of the flowable product from the package.

It is a further object of the invention to provide a package which can be easily refilled from any type of container, provided this container is pierceable by the refill facilitating pouring spout incorporated in the package.

SUMMARY OF THE INVENTION

In order to accomplish the above stated objectives, the present invention provides a flowable product package, the neck of which is equipped with a pouring spout for easy delivery of the contents, the free end of the pouring spout being so shaped that it will be able to act as a piercing element for refill packages, while still retaining its function as pouring spout. In a preferred embodiment, the pouring spout is integrated in a transition piece which also comprises a self-draining feature, through which any product running down the pouring spout is guided back into the inside of the container.

BRIEF DESCRIPTION OF THE DRAWINGS

While the specification concludes with claims particularly pointing out and distinctly claiming the present invention, it is believed that the same will be better understood from the following description taken in conjunction with the accompanying drawings:

DETAILED DESCRIPTION OF THE INVENTION

Figure 1:
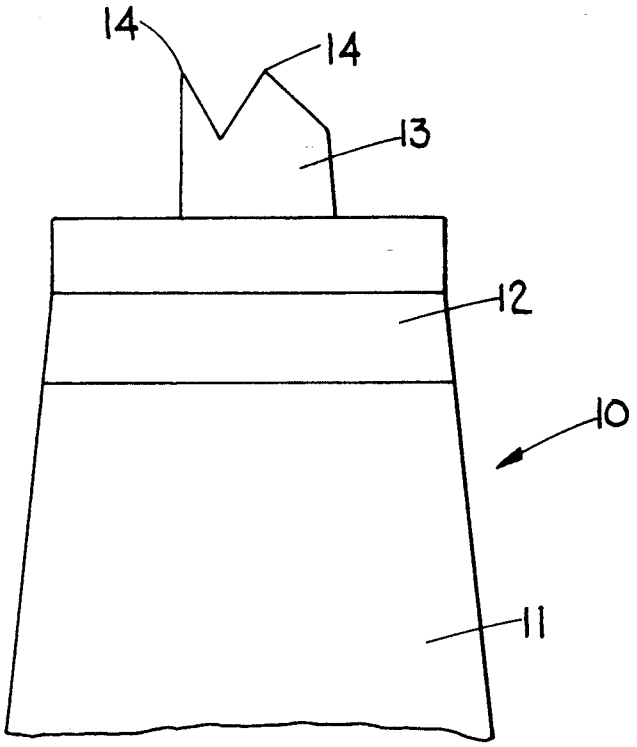
FIG. 1 is a fragmentary, front elevational view of a preferred embodiment of the package of the present invention without a closing cap.

Referring now to the drawings in detail, wherein like reference numbers indicate the same elements throughout the use, there is illustrated a preferred embodiment of a flowable product package incorporating a refill facilitating pouring spout according to the present invention.

As can be seen from FIG. 1, the package (10) includes a flowable product container (11), a transition piece (12) mounted on the container dispensing opening, this transition piece incorporating, among others, a refill facilitating pouring spout (13). The free extremity of the refill facilitating pouring spout is so shaped that it constitutes piercing element (14). Piercing element (14) is comprised of a plurality of sharp points along the free end of pouring spout (13). Piercing element (14) also comprises a plurality of corresponding valleys located above the uppermost rim of the drain-back area. The closing cap which normally completes the package is not shown since it is not part of the invention.

Figure 2:
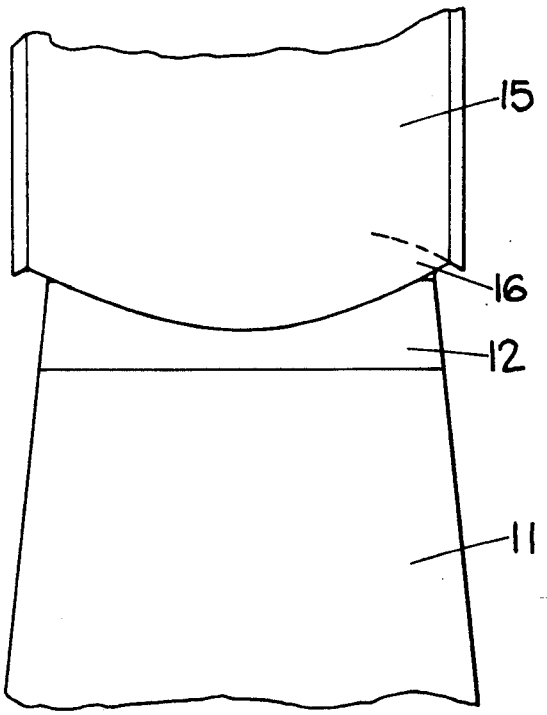
FIG. 2 is a fragmentary front elevational view of the embodiment of FIG. 1, showing a refill package positioned on the refill facilitating pouring spout.

FIG. 2 shows the package of FIG. 1 but with refill package (15) positioned on top and over refill facilitating pouring spout (13) with piercing element (14). As will be evident to one of ordinary skill in the art, the product contained in refill package (15) will run out of its bottom (16) when it has been broken open by the sharp points of piercing element (14) and will run into the container (11) through transition piece (12).

Figure 3:
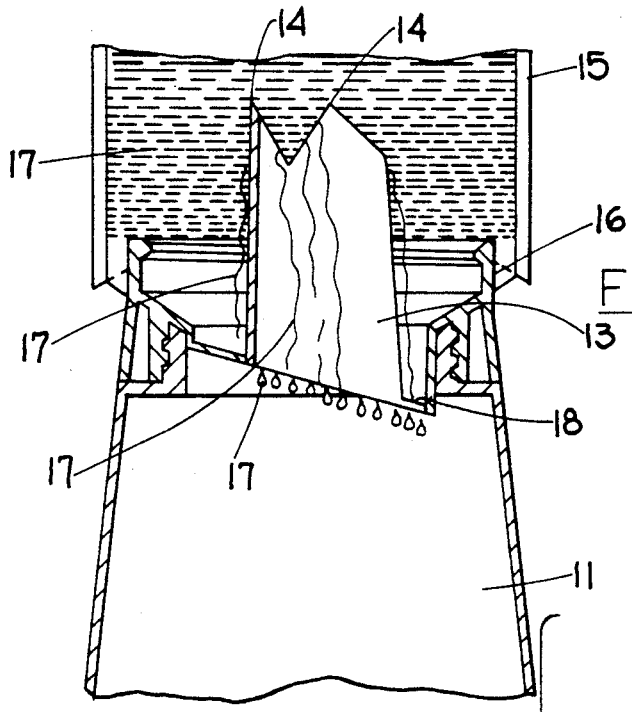
FIG. 3 is a fragmentary, vertical, cross-sectional view of FIG. 2.

The cross-sectional view of FIG. 3 shows how refill facilitating pouring spout (13) with piercing element (14) has entered the refill package through bottom (16). Product (17) runs through the refill facilitating pouring spout (13) into container (11) while any product running over the outside walls of refill facilitating pouring spout (13) runs into the container via drain-back area (23) through vent-drain hole (18). Once refill package (15) is completely empty, it can be thrown away. The product (17) shown in FIG. 3 of the preferred embodiment is a liquid.

Figure 4:
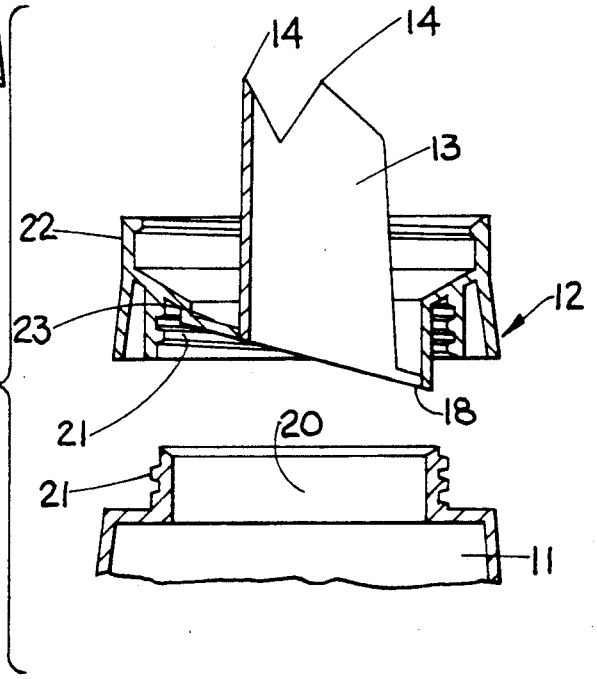
FIG. 4 is a fragmentary, exploded, vertical, cross-sectional view of the refill facilitating pouring spout integrated with a self-draining feature in a transition piece and taken along the line 2—2 of FIG. 3, positioned above the package neck prior to attachment.

FIG. 4 is a cross-sectional, exploded, view showing the transition piece (12) incorporating refill facilitating pouring spout (14) and the drain-back feature consisting of inclined drain-back area (23) having an uppermost rim and vent/drain hole (18), according to the preferred embodiment of the invention, and how this transition piece corresponds with container neck (20) on which it can be attached by screwthreads (21).

Figure 5:
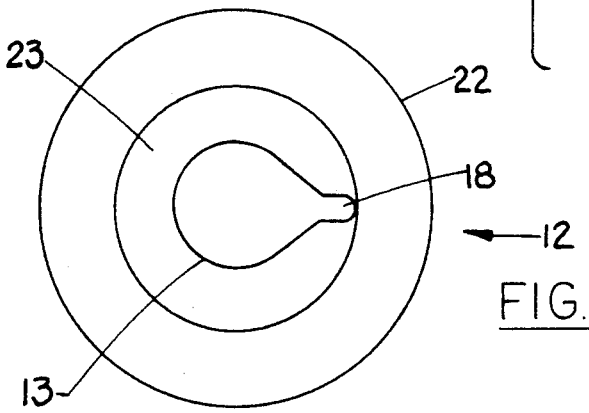
FIG. 5 is a top view of the preferred embodiment of a refill facilitating pouring spout according to the invention integrated with a self-draining feature in a transition piece.

FIG. 5 is a top view of the preferred embodiment of the transition piece described in FIG. 4, whereby this transition piece (12) with its outside circular wall (22), its inclined drain-back area (23), its refill facilitating pouring spout (13) and its vent/drain hole (18) acts as a funnel for any product running out of refill package (15) shown in FIGS. 2 and 3.

Figure 6:
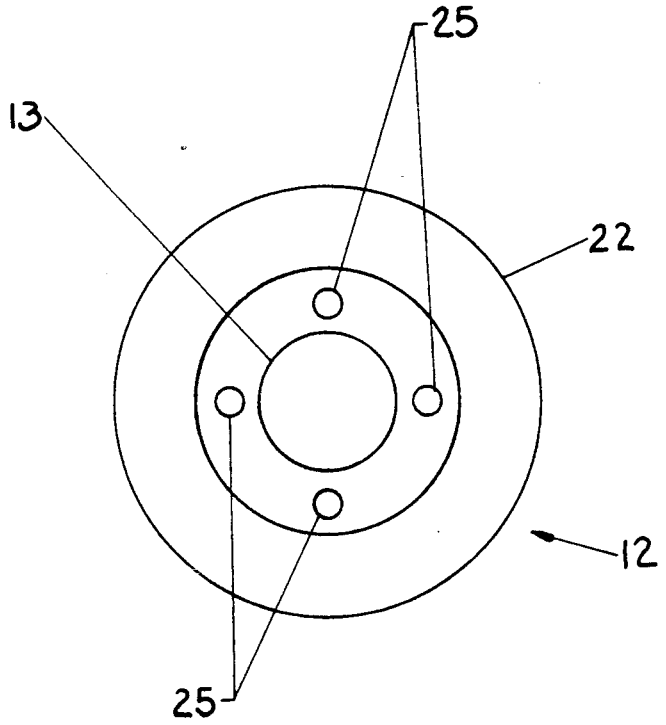
FIG. 6 is a top schematic view of a refill facilitating pouring spout with peripheral openings surrounding the pouring spout.

While the preferred embodiment discloses a refill facilitating pouring spout which is part of a transition piece with inside screwthread for fastening the container cap and serving at the same time as a self-draining feature, it will be evident to one of ordinary skill in the art that the invention also encompasses executions without self-draining feature but whereby the refill facilitating pouring spout is part of a simple insert with peripheral openings (25) surrounding the spout, located within the bottle neck shown in FIG. 6. It also covers refill facilitating pouring spouts incorporated in a transition piece with outside thread for fastening the container cap onto it. Also, the exact configuration of the refill facilitating pouring spout can vary as long as it can fulfill both functions of piercing and pouring.

Where the refill package of the preferred embodiment is a flexible plastic pouch, any other refill packages, pierceable by the refill facilitating feature of the present invention in any location of their configuration, are also encompassed This applies, e.g. to cartons with or without liner, which can possibly have a partially weakened area for easier piercing.

The refill facilitating pouring spout described in the preferred embodiment is preferably made of polypropylene or polyethylene but can be made of any suitable material known to one of ordinary skill in the art.

The transition piece incorporating the refill facilitating pouring spout as well as the self-draining feature can be attached to the bottle by any conventional means. Attaching it by a screwthread has the additional advantage that, if the user prefers not to use the refill facilitating pouring spout for refilling the package but prefers to fill it through the free neck opening, using or not using a conventional funnel, this can be done easily by unscrewing the transition piece.

Various modifications of the described invention will be apparent to those skilled in the art. Examples of several such variations have been mentioned above. Accordingly, the scope of the present invention should be considered in terms of the following claims and is understood not to be limited to the details or structures described and shown in the specification and drawings.

I claim:

1. Flowable product package for receiving the liquid contents of a flexible refill pouch, said package comprising: a body and a neck portion, said neck portion being equipped with a pouring spout and a drain-back area connecting said body to said pouring spout, said drain-back area including means for draining liquid product into said package and an uppermost rim, said pouring spout having an upwardly projecting free end, said free end of said pouring spout projecting beyond the uppermost rim of said drain-back area, said free end of said pouring spout having a piercing element with a plurality of sharp points for piercing said flexible refill pouch and a plurality of corresponding valleys, said corresponding valleys also being above said uppermost rim of said drain-back area, whereby liquid product running over said pouring spout flows into said drain-back area and enters said package through said means for draining liquid product into said package.

2. Flowable product package for receiving the liquid contents of a flexible refill pouch according to claim 1, wherein said neck portion equipped with said pouring spout and said drain-back area is a separate transition piece releasably secured to said package.

3. Flowable product package for receiving the liquid contents of a flexible refill pouch according to claim 1, wherein said means for draining liquid product into said package comprises a plurality of peripheral openings surrounding said pouring spout.

4. Flowable product package for receiving the liquid contents of a flexible refill pouch according to any one of the preceding claims, wherein said pouring spout is made of polypropylene.

5. Flowable product package for receiving the liquid contents of a flexible refill pouch according to claim 1 wherein said means for draining liquid products into said package includes a drain hole.

6. A flowable product package for receiving the liquid contents of a flexible refill pouch according to claim 2 wherein said transition piece is releasably secured to said package by screw threads.

* * * * *